US005217398A

United States Patent [19]

Meron et al.

[11] Patent Number: 5,217,398

[45] Date of Patent: Jun. 8, 1993

[54] PEDAL OPERATED CATAMARAN

[75] Inventors: Abraham Meron, Hudson, Wis.; Masanori Sugita, Spring Lake Park, Minn.

[73] Assignee: Yamaha Hatsudoki Kabushiki Kaisha, Japan

[21] Appl. No.: 868,225

[22] Filed: Apr. 14, 1992

[51] Int. Cl.[5] ..... B63H 16/18

[52] U.S. Cl. ..... 440/26; 440/21

[58] Field of Search ..... 440/21, 26, 27–31, 440/54, 63, 75; 114/61

[56] References Cited

U.S. PATENT DOCUMENTS

| | | | |
|---|---|---|---|
| 1,568,831 | 1/1926 | Hamm, Jr. | 440/31 |
| 4,698,034 | 10/1987 | Anthonijsz | 440/27 |
| 4,943,251 | 9/1990 | Lerach et al. | 440/28 |

FOREIGN PATENT DOCUMENTS

| | | | |
|---|---|---|---|
| 831040 | 4/1938 | France | 440/27 |

OTHER PUBLICATIONS

Mallard, Hoyt-Harken, "A New Kind of Boating Fun" and A New All Purpose Small Boat, Watercycle Inc., One Harborview Drive, Newport, Rhode Island 02840.

Venture Cat, Recumbent Pedal Catamarans, Enterprise, Inc., 88 Temple Drive, Methuen, Mass. 01844.

Herrit Marine Design, 134 Garfield Avenue, Butler, Pa. 16001.

*Human Power*, Summer, 1987, vol. 6, No. 2, pp. 10–12, "Design and Test of a HPB Propeller", David Gordon Wilson.

Acomo, Acomo Produktion AG, Seefeldstrasse 10, CH-3600 Thun.

"Design International", *Machine Design*, Nov. 12, 1987,

Bike Boat Holland B.V., Oranje Nassaustraat 1A, 2271 SJ Voorburg.

*City Sports 71*, Jul., 1990, Velo Pages, "The Bold Man and the Sea", by Bob Howells.

Art Javes Designs, Inc., 4914 17th Avenue South, Gulfport, Florida 33707.

Bobcat Engineering Corporation, 1829 South Horne, #7 Mesa, Arizona 85204, "Bobcat Fact Sheet".

*Human Power*, The Technical Journal of the IHPVA, vol. 8, No. 1, Summer 1990, "The Human-Powered Submersible Race: a Review from Down Under", by James Osse; and other articles, pp. 1–24.

*Primary Examiner*—Edwin L. Swinehart

*Attorney, Agent, or Firm*—Haugen and Nikolai

[57] ABSTRACT

A pedal operated catamaran includes a pair of side-by-side buoyant hulls, and a rigid frame releasably mounted to the hulls in one of two alternative positions, to maintain the hulls parallel to one another. The catamaran includes a propeller mounted for rotation with an elongated, longitudinal propeller drive shaft. A gear train drivably associates the propeller drive shaft and a crankshaft, for propeller rotation responsive to rotation of the crankshaft. The propeller drive shaft further is pivotally mounted to allow selective alternative latching of the propeller in a retracted position and in one of several operating positions, as controlled by a hand-operated lever. The latching mechanism allows on-the-fly adjustment of the propeller position. In the retracted position, the propeller is automatically angularly locked above the hulls, to facilitate car top carrying of the craft without disassembly.

21 Claims, 2 Drawing Sheets

PEDAL OPERATED CATAMARAN

BACKGROUND OF THE INVENTION

The present invention relates to recreational watercraft, and more particularly to a catamaran with a manually operated propulsion system.

A wide variety of devices are available for powering watercraft, ranging from paddles, oars and sails to gasoline powered outboard motors and electric trolling motors. Given the present public awareness of the diminishing supply of fossil fuels and the environmental impact of the combustion of these fuels, there is a heightened interest in finding means to propel recreational watercraft other than by gasoline or electric motors. Such alternate, manual propulsion means afford the advantage of low noise operation, and require no gasoline, oil, batteries or other auxiliary energy sources.

One well known manual system employs a paddle wheel driven by a pedal and crank assembly. The pedal and crank assembly is rotated in much the same manner as a pedal and crank assembly on a typical bicycle. Such systems are inefficient, and require substantial effort for moving a watercraft relatively slowly over short distances.

U.S. Pat. No. 4,943,251 (Lerach et al) discloses a pedal operated drive system for canoes. The drive system employs a pedal and crank assembly to rotate a propeller positioned behind the canoe, for substantially improved performance as compared to paddle wheel systems. A frame supports the pedal and crank assembly, the propeller, and the intermediate drive connections, and is removably mounted to the canoe.

The catamaran hull design is well-known in connection with recreational watercraft, for example catamaran sailboats. Other types of manually operated watercraft with catamaran hulls are commercially available. However, these tend to be heavy, bulky, and require disassembly for transport over land. Varying conditions, e.g. the depth of water, presence or absence of weeds, and the wind speed, give rise to the need for adjusting the watercraft in response, a need not well met by conventional watercraft designs.

Therefore, it is an object of the present invention to provide a catamaran that can be conveniently transported by cartop, without disassembly of the watercraft.

Another object is to provide a pedal operated system for manually powering a watercraft, in which the moving parts can be locked into a retracted position for land transport.

A further object of the invention is to provide a propeller drive system for watercraft, including means for quickly and conveniently trimming the propeller in response to varying water conditions while the watercraft is afloat and in motion.

Yet another object is to provide a manually operated system for powering a catamaran, which can be adjusted to suit persons of different heights and weights without unduly altering catamaran steering and other handling characteristics.

SUMMARY OF THE INVENTION

To achieve these and other objects, there is provided a manually propelled watercraft. The watercraft has a buoyant hull means including two spaced apart hull portions having respective bottom surface portions. A rigid frame means is connected to the buoyant hull means. A manual drive means is mounted for cyclical movement relative to the rigid frame means. The watercraft further includes a rotatable propeller drive member, and a propeller mounted integrally to the propeller drive member. A coupling means operably joins the propeller drive member and the manual drive means, to rotate the propeller responsive to the cyclical movement of the manual drive means. A mounting means is provided for mounting the drive member for movement relative to the rigid frame means. This allows movement of the propeller between a retracted position in which it is above the bottom surface portions, and a plurality of operating positions in which the propeller is under water when the hull means is afloat. A propeller position control means is provided for releasably and adjustably securing the mounting means, thus to selectively locate the propeller in alternative positions including the various operating positions and the release position.

The preferred propeller drive member is an elongate propeller drive shaft rotatable about its longitudinal axis. The manual drive means can comprise a pedal and crank assembly and a main drive gear integral with the cranks of the pedal and crank assembly. The coupling means can be a gear train drivably associating the main drive gear and the propeller drive shaft. The gear train preferably includes an intermediate gear that rotates about an intermediate axis parallel to the main drive axis and perpendicular to the longitudinal axis of the drive shaft.

According to one aspect of the present invention, the propeller drive shaft is mounted to pivot about the intermediate axis. This arrangement permits a smooth, on the fly adjustment of the propeller position by pivoting the drive shaft, with gears of the gear train remaining coupled to one another during shaft pivoting.

The propeller drive shaft can be controlled by a pivot arm connected to the rigid frame means. A sleeve, rotatably and slidably mounted on the propeller drive shaft, is pivotally secured to the pivot arm. A hand operable lever, and linking means joining the lever and the pivot arm, permit control of the pivot arm in response to pivoting of the lever. A bracket, mounted to the rigid frame means near the hand operable lever, has an arcuate slot with several notches corresponding to the retracted position and the several operating positions of the propeller. A latching member carried by the lever can be removably positioned in any of the notches to set the lever, and thus the propeller, in the desired position.

In the retracted position the propeller shaft and propeller can be angularly locked. Locking is accomplished through a pair of pins integral with the propeller drive shaft and a specially shaped locking edge of the sleeve that surrounds the propeller drive shaft. More particularly, as the propeller drive shaft is moved toward the retracted position, the sleeve slides along the shaft until the locking edge encounters the pins. As the sleeve slides further, the locking edge forces the pins, and thus the propeller drive shaft, into a predetermined locked angular position. Preferably the propeller consists of two blades angularly spaced apart from one another 180°, so that the blades extend horizontally in the locked angular position. This insures that the propeller is entirely above the hull bottom portions when retracted and locked. As a result, the watercraft can be conveniently placed upright onto a cartop or pickup truck bed and secured without damage to the propeller due to contact with the vehicle or vibration during transit.

The preferred hull means consists of two buoyant hulls held in parallel, spaced apart relation to one another by the frame means. The frame means is releasably secured to the hulls in two alternative positions. A seat is releasably and adjustably secured to the frame means, centered between and above the hulls, yet below the pedal and crank assembly. This arrangement lowers the operator's center of gravity, permitting a closer spacing between the catamaran hulls yet maintaining stability of the watercraft. More preferably, the seat is adjustable along an inclined track, whereby a larger person would tend to adjust the seat to a lower as well as more rearward position, thus counteracting the tendency for a larger person to have a higher center of gravity.

A further compensation for individuals of different sizes is the releasable attachment of the frame means to the hulls, providing "fore" and "aft" frame positions. Taller operators, tending to position the adjustable seat rearwardly, also can secure the frame in its "fore" position to compensate for the rearward shift in center of gravity.

The ability to trim the propeller shaft, i.e. to set the propeller at a variety of operating positions, allows the operator to adjust to varying conditions and preferences. More particularly, an uppermost operating propeller position is desired for higher speeds, and also may be necessary in shallow water or in water with weed growth near the surface. On the other hand, a lower setting is preferred in rough, choppy water.

Thus, in accordance with the present invention a catamaran is manually powered at a variety of propeller position settings, accommodates individuals of different sizes with minimal variance in steering or other operating conditions, and is conveniently transported by car or truck, without disassembly.

IN THE DRAWINGS

DETAILED DESCRIPTION OF THE PREFERRED EMBODIMENT

Figure 1:
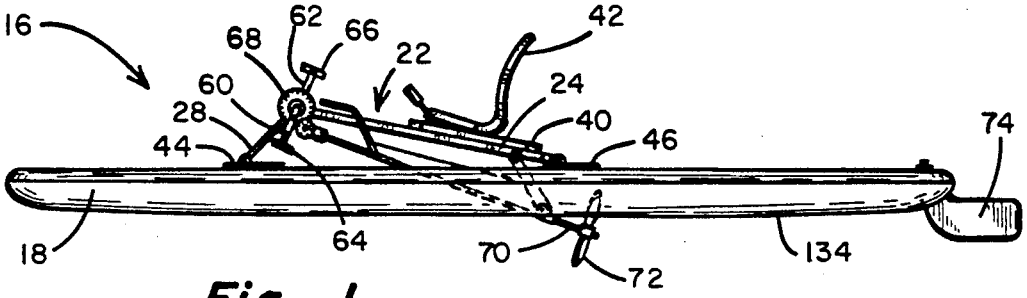
FIG. 1 is a side elevational view of a pedal operated catamaran constructed according to the present invention.
Figure 2:
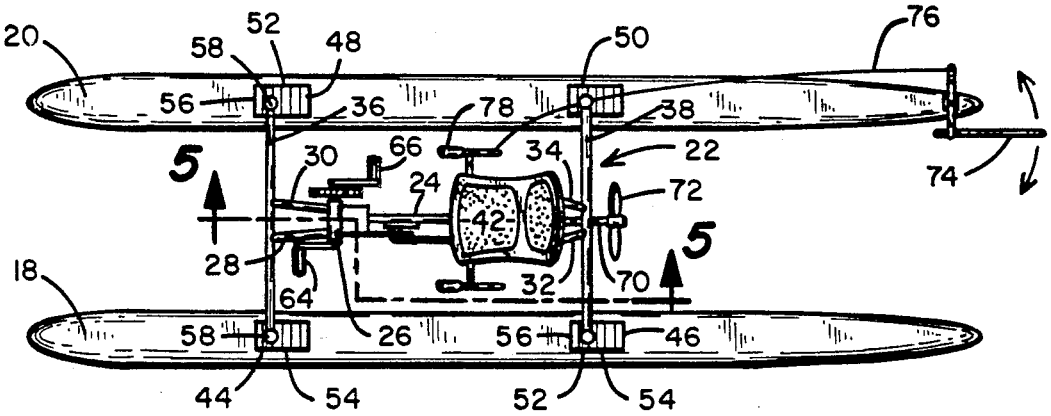
FIG. 2 is a top plan view of the catamaran.

Turning now to the drawings, there is shown in FIGS. 1 and 2 a pedal operated catamaran 16. Catamaran 16 includes a pair of elongate, buoyant hulls 18 and 20, constructed of a high tensile strength polyamide fiber, e.g. such as that sold under the trademark Kevlar and available from Du Pont de Nemours & Company. Other suitable materials for the hulls include polyethylene and fiberglass. A steel framework 22 is releasably secured to hulls 18 and 20, to maintain the hulls parallel and spaced apart from one another. Frame 22 includes a longitudinal center bar 24, a crankshaft housing 26, two forward members 28 and 30, a pair of rear support bars 32 and 34, and forward and rearward transverse bars indicated respectively at 36 and 38.

A track 40, rigidly secured to longitudinal center bar 24, supports a seat 42 for the operator of the catamaran. Bar 24 and track 42 are inclined upwardly in the forward direction (to the right as viewed in FIG. 1), to permit adjustable positioning of seat 42, as is later explained.

Framework 22 is releasably mounted to the catamaran hulls. More particularly, each hull includes a pair of frame mounting pads, each formed as a relief in an otherwise generally smooth top surface of the hull. Hull 18 includes a forward mounting pad 44 and a rearward mounting pad 46, and hull 20 similarly includes forward and rearward mounting pads at 48 and 50, respectively.

Each mounting pad has a pair of transverse grooves, including a forward groove 52 and a rearward groove 54. As shown in FIGS. 1 and 2, transverse bars 36 and 38 are received into the forward grooves, and releasably secured by four mounting clamps 56 and four threaded fasteners 58. Each clamp and threaded fastener pair is associated with one of the mounting pads, and can secure the associate transverse bar in either grooves 52 as shown or in rearward grooves 54.

Crankshaft housing 26 of the framework supports a pedal and crank assembly for rotation relative to the framework. The pedal and crank assembly includes cranks 60 and 62 on opposite sides of housing 26, and pedals 64 and 66 associated with cranks 60 and 62, respectively. A main drive gear 68 is an integral part of the pedal and crank assembly Framework 22 further supports a propeller drive shaft 70 extending longitudinally and rotatable on a longitudinal axis, and a propeller 72 integral with the drive shaft.

Catamaran 16 is steered with the aid of a rudder 74 mounted with respect to hull 20 as shown, and pivotable about a vertical axis A cable 76, operated through a hand lever 78, controls the rudder position.

Figure 4:
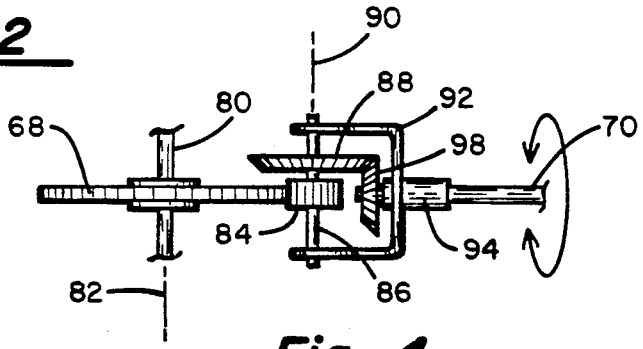
FIG. 4 is a top view of the gear train taken along the line 4–4 in FIG. 3.
Figure 3:
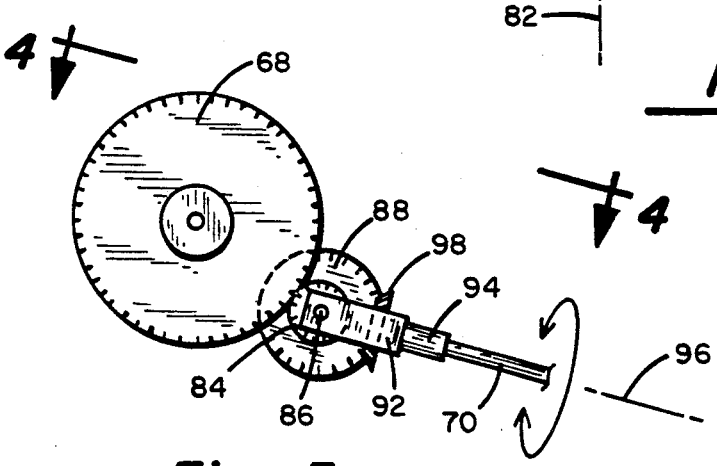
FIG. 3 is an enlarged view of a gear train of the catamaran.

A gear train drivably engages the pedal and crank assembly with drive shaft 70, to enable rotation of propeller 72 by rotating the pedal and crank assembly As seen in FIGS. 3 and 4, main drive gear 68 is part of this gear train. A crankshaft 80, concentric with the main drive gear, is integral with cranks 60 and 62 and with the main drive gear, and further is mounted within housing 26 for rotation relative to the housing about a main drive axis 82. Thus, the catamaran operator rotates crankshaft 80 by manipulating the pedals in much the same manner as the operator would power a bicycle. An intermediate gear 84 is engaged with main drive gear 68 for rotation with the main drive gear. An intermediate shaft 86, parallel to the crankshaft, is integral with the intermediate gear, and in turn, integrally supports a bevel gear 88 for rotation with intermediate gear 84 about a transverse intermediate axis 90, as crankshaft 80 and main drive gear 68 rotate about main drive axis 82.

A drive shaft support bracket 92 is mounted on intermediate shaft 86 and pivots about the intermediate axis. A sleeve 94 integral with the bracket supports propeller drive shaft 70 for rotation about a longitudinal axis 96. At the forward end of drive shaft 70 is a bevel gear 98 engaged with bevel gear 88. Thus, manipulation of the pedal and crank assembly causes the propeller drive shaft to rotate, due to a gear train that includes drive gear 68, intermediate gear 84 and bevel gears 88 and 98.

Figures 5, 6, 7, 8, 9:
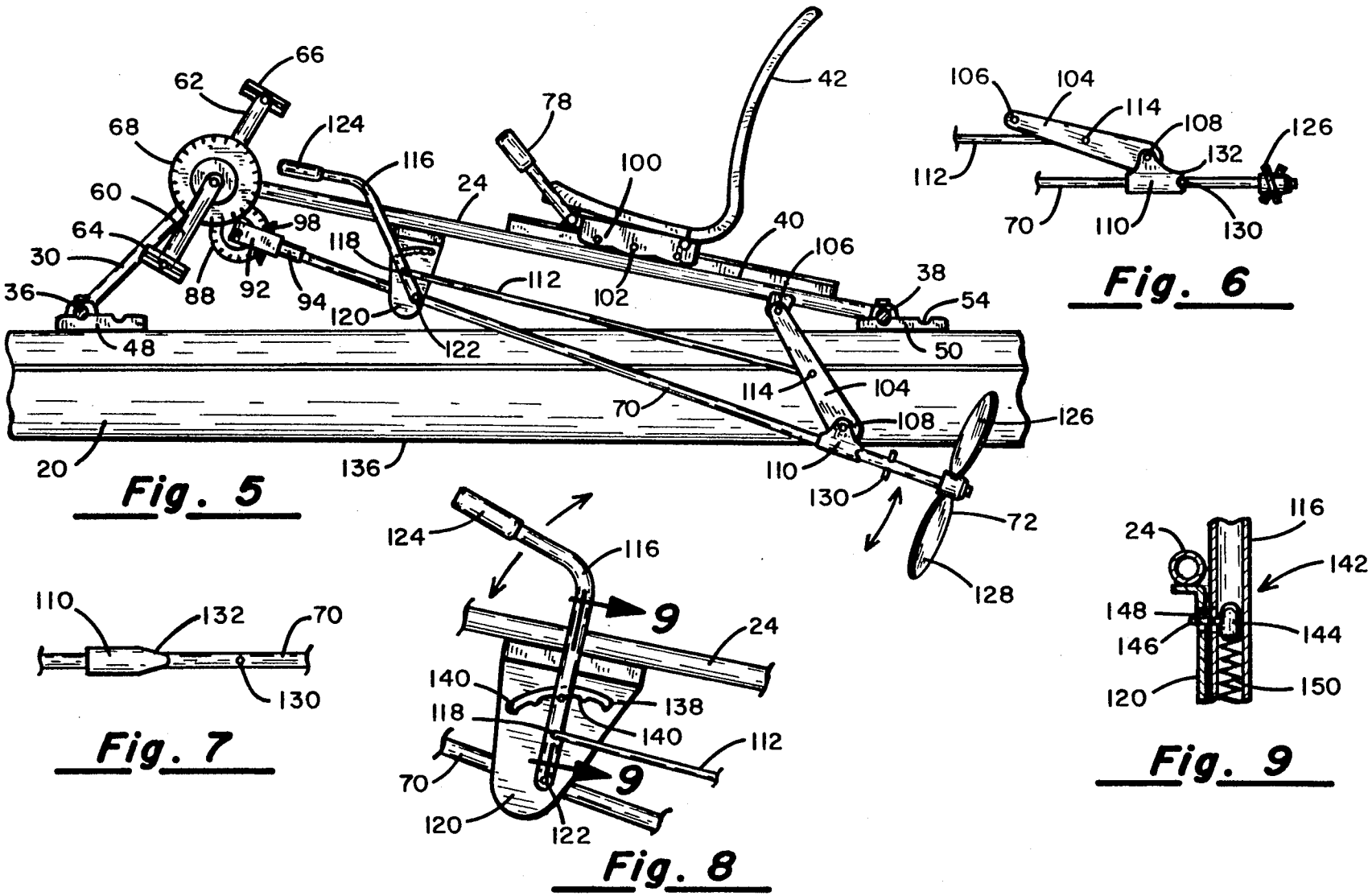
FIG. 5 is an enlarged partial side sectional elevation of the catamaran, as taken along the line 5–5 in FIG. 2, showing a propeller and propeller drive shaft in an operating position.
FIG. 6 is a side elevation of a portion of FIG. 5, illustrating the propeller and propeller shaft in a retracted position.
FIG. 7 is a bottom plan view of a portion of the propeller drive shaft and a surrounding sleeve.
FIG. 8 is an enlarged side elevation of a portion of FIG. 5.
FIG. 9 is a sectional view taken along the line 9—9 in FIG. 8.

As noted above, seat 42 is moveable along inclined track 40. This permits adjustment of the seat to accommodate operators of different sizes. As seen in FIG. 5, a bracket 100, integral with and immediately beneath the seat, is slidable along the track. A plurality of openings through bracket 100 are positionable in alignment with selected ones of a corresponding set of openings through track 40. Pins 102, when extended through the track openings and seat bracket openings and secured by a threaded nut, cotter pin or the like, releasably secure seat 42 in one of several alternative positions.

Taller operators tend to prefer more leg room, and thus are likely to adjust seat 42 rearwardly, or to the right as viewed in FIG. 5. Due to the incline of track 40, such an adjustment also lowers seat 42. This tends to lower the combined center of gravity (i.e. the center of gravity of the catamaran and operator considered together). This counteracts the tendency toward a higher combined center of gravity for taller operators, thus enhancing watercraft stability.

At the same time, this seat adjustment moves the combined center of gravity rearward which is not desirable. Accordingly, mounting pads 44–50 provide compensation in allowing the operator to releasably secure framework 22 to the hulls in alternative "fore" and "aft" positions. The framework is shown in the fore position in FIG. 5, in which transverse bars 38 and 40 are secured in forward transverse grooves 52 of the mounting pads, by clamps 56 and threaded fasteners 58. Adjustment of the framework to the aft position is accomplished by removing the clamps and threaded fasteners, shifting the framework rearward such that the transverse bars rest in grooves 54 of the mounting pads, then resecuring the framework with the clamps and threaded members. Taller individuals, tending to position seat 42 rearwardly, thus also tend to position framework 22 in the fore position to compensate for the rearward shift in center of gravity.

A feature of the present invention is the ability to trim propeller 72 and shaft 70, to accommodate varying operating conditions and facilitate transport of the catamaran on a car top without disassembly. As previously noted, propeller drive shaft 70 is mounted to pivot about transverse intermediate axis 90. Structure for controlling and adjustably positioning the drive shaft and propeller includes a pivot arm 104. At its upper end, the pivot arm is mounted to pivot relative to framework 22 about a transverse pivot axis 106. At its bottom end, the pivot arm is mounted to pivot about a transverse pivot axis 108 relative to a drive shaft support sleeve 110. Propeller drive shaft 70 is surrounded by sleeve 110 and rotates about the longitudinal axis relative to the sleeve. Shaft 70 and sleeve 110 further are slidable relative to one another.

A linking rod 112 is pivotally secured to a medial region of arm 104, to pivot relative to the arm about a transverse pivot axis 114. The forward end of the linking rod is pivotally attached to a hand operated control lever 116, for pivoting about a transverse axis 118. A bracket 120, affixed to longitudinal center bar 24, supports control lever 116 for pivoting with respect to the framework about a transverse pivot axis 122. A grip 124 at the upper end of the control lever facilitates manipulation of the lever by hand.

Propeller 72 includes propeller blades 126 and 128 angularly spaced apart from one another 180 degrees. A propeller locking pin 130 is mounted to propeller drive shaft 70 and extends transversely away from opposite sides of the drive shaft, in angular alignment with the propeller blades. On the side of sleeve 110 facing pin 130 and the propeller is a guide edge 132.

Control lever 116 allows the operator to adjust the position of drive shaft 70 and propeller 72 to accommodate varying conditions and preferences. The lowest or deepest operating position (FIG. 5) is preferred in rough or choppy water. However, higher speeds can be achieved when propeller 72 is in its uppermost operating position. The uppermost position also may be necessary in shallow water, or water in which weeds are present near the surface. FIG. 6 illustrates the propeller and drive shaft in the retracted position, in which the propeller is above respective bottom surfaces 134 and 136 of hulls 18 and 20. This facilitates transport of catamaran 16, by permitting its placement, upright, onto a car top or other generally horizontal surface, with the propeller protected from contact with the surface.

Retraction of propeller 72 is accomplished by pulling control lever rearward or clockwise as illustrated in FIG. 5. This drives linking rod 112 rearward, which pivots arm 104 counterclockwise, in turn pivoting drive shaft 70 counterclockwise to lift propeller 72 above the hull bottom surfaces as sleeve 110 slides rearwardly along the drive shaft. Before propeller 72 and drive shaft 70 reach the retracted position, guide edge 132 of the sleeve engages propeller locking pin 130. The propeller and drive shaft may be generally vertically disposed as in FIGS. 5 and 7. Nonetheless, once guide edge 132 engages locking pin 130, further rearward movement of sleeve 110 along drive shaft 70 angularly drives the locking pin, to rotate propeller 72 into a retracted angular position in which blades 126 and 128 extend horizontally. As best seen in FIG. 6, guide edge 132 forms a recess which captures the locking pin, thus to firmly secure the propeller drive shaft in the retracted angular position for transit.

The propeller and drive shaft are adjustably positionable into several operating positions, as well as the retracted position. As best seen in FIG. 8, an arcuate slot 138 through bracket 120 includes several notches 140. The most forward (leftward) notch corresponds to the fully forward control lever position and maximum propeller depth as shown in FIG. 5. The most rearward notch corresponds to the retracted position. In FIG. 8, control lever 116 is shown in an intermediate operating position.

Control lever 116 can be releasably latched into any one of four alternative operating positions and the retracted position. For this purpose, a latch 142 is mounted for movement relative to control lever 116. As seen in FIG. 9, the latch includes a latch support 144 contained within the lever, and a latch pin 146 extended transversely outward through a slot 148 in lever 116. A spring 150 under compression biases latch support 144 upwardly. Latch pin 146 further extends through arcuate slot 138, and travels in an arc along the slot as control lever 116 is pivoted about axis 122. As the pin encounters each notch 140, the pin is urged into the notch by the force of spring 150 upon latch support 144. Thus, pin 146 releasably secures control lever 116 in the selected position, securing the propeller and drive shaft in the release position or the selected operating position. The profile of notches 140 and the spring force of coil spring 150 are selected to maintain control lever 116 firmly in the selective position, yet to facilitate convenient, on the fly adjustment of the propeller depth during operation of the catamaran. More particularly, the profile of each notch provides a camming surface that drives latch pin 146 downward against the spring force, responsive to pivoting of the control lever. The restoring force of spring 150 is selected to maintain latching pin 146 in a selected notch, yet to readily yield to the camming action when the operator manipulates control lever 116.

Thus, in accordance with the present invention a propeller driven watercraft can be immediately and conveniently adjusted among several operating positions, and further locked into a stable retracted position for convenient car top transport without the need to disassemble the watercraft. Individuals of different heights can adjust the seat and frame positions as desired, with minimal vertical or horizontal shift in the combined center of gravity of the craft and operator, and thus minimal variance in steering or other operating conditions.

What is claimed is:

1. A manually propelled watercraft, including:

a buoyant hull means including two spaced apart hull portions having respective bottom surface portions;

a rigid frame means connected to the buoyant hull means;

a manual drive means mounted for cyclical movement relative to the rigid frame means;

an elongate propeller drive shaft having a longitudinal drive shaft axis and rotatable about the longitudinal axis, and a propeller mounted integrally to the propeller drive shaft;

a coupling means for operably coupling the propeller drive shaft and the manual drive means, to rotate the propeller responsive to the cyclical movement of the manual drive means;

a mounting means for mounting the propeller drive shaft for movement relative to the rigid frame means between a retracted position in which the propeller is above the bottom surface portions, and a plurality of operating positions in which the propeller is under water when the hull means is afloat wherein the mounting means includes a pivot arm having a first end pivotally secured to the rigid frame means, and a sleeve pivotally secured to a second end of the pivot arm and mounted for longitudinal sliding and for rotation relative to the propeller drive shaft; and a propeller position control means for releasably and adjustably securing the mounting means to selectively locate the propeller in alternative ones of the operating positions and the retracted position.

2. The watercraft in claim 1 wherein:

the hull means includes two buoyant hulls held in spaced apart relation to one another by the frame means.

3. The watercraft of claim 1 wherein:

the manual drive means includes a pedal and crank assembly and a main drive gear integral with first and second cranks of the pedal and crank assembly and rotatable about a main drive axis.

4. The watercraft of claim 3 wherein:

the coupling means includes a gear train drivably associating the main drive gear and the propeller drive shaft.

5. The watercraft of claim 4 wherein:

the gear train includes an intermediate gear rotatable about an intermediate axis parallel to the main drive axis and perpendicular to the longitudinal shaft axis.

6. The watercraft of claim 5 wherein:

the mounting means mounts the propeller drive shaft pivotally about the intermediate axis.

7. The watercraft of claim 1 wherein:

the mounting means further includes a hand operable lever pivotally mounted to the rigid frame means, and a linking means joining the lever and the pivot arm to enable controlled pivoting of the pivot arm in clockwise and counterclockwise directions by pivoting of the lever.

8. The watercraft of claim 7 wherein:

the position setting means comprises a bracket mounted to the rigid frame means near the hand operable lever and having an arcuate slot and a plurality of notches formed along the arcuate slot, each notch corresponding to one of the retracted position and the operating positions; and a latching member mounted movably to the lever and extended through the arcuate slot, and a biasing means for urging the latching member into a selected one of the notches to releasably secure the lever and thereby selectively position the propeller.

9. The watercraft of claim 1 further including:

a means for locking the propeller and drive shaft against rotation when the propeller is in the retracted position.

10. The watercraft of claim 9 wherein:

the means for locking the propeller and drive shaft include a pin integrally mounted to the shaft, and a guide edge at the end of the sleeve confronting the propeller, said guide edge engaging the pin as the sleeve slides along the shaft toward the retracted position, and controlling pin movement responsive to further sliding of the sleeve beyond the point of engagement, to rotate the shaft into a locked angular position.

11. The watercraft of claim 10 wherein:

the propeller has two blades angularly spaced apart 180°, and the blades extend horizontally when in the locked angular position.

12. The watercraft of claim 2 further including:

a means for releasably securing the frame means to the hulls, and a seat releasably secured to the frame means above and between the hulls.

13. The watercraft of claim 12 wherein:

said securing means releasably secures the frame means in at least two alternative positions relative to the hulls.

14. A catamaran, including:

a pair of buoyant hulls having respective bottom surface portions, and a rigid frame means secured to the buoyant hulls and maintaining the hulls in parallel spaced apart relation;

a drive assembly including a crankshaft rotatable about a drive axis;

an elongate propeller drive member having a longitudinal axis and rotatable about the longitudinal axis, and a propeller mounted integrally to the propeller drive member;

a coupling means for operably coupling the propeller drive member and the crankshaft, to rotate the propeller responsive to rotation of the crankshaft, said coupling means including a gear rotatable about a gear axis parallel to the drive axis and perpendicular to the longitudinal axis; and a mounting means for mounting the drive member for pivotal movement relative to the rigid frame means about the gear axis, between a retracted position in which the propeller is above the bottom surfaces, and at least one operating position in which the propeller is under water when the hulls are afloat.

15. The catamaran of claim 14 further including:

a propeller position setting means for releasably and adjustably securing the mounting means to selectively locate the propeller in alternative ones of the release position and said at least one operating position.

16. The catamaran of claim 15, wherein:

the propeller drive member comprises a drive shaft, and the mounting means includes a pivot arm pivotally secured to the frame means at a first end thereof, and a sleeve pivotally secured to a second end of the pivot arm and secured for longitudinal sliding and for rotation relative to the drive shaft.

17. The catamaran of claim 16 wherein:

the mounting means further includes a hand operable lever pivotally mounted to the frame means and operably coupled to the pivot arm; and wherein the position setting means includes a bracket mounted to the rigid frame means near the lever and having an arcuate slot and a plurality of notches formed along the arcuate slot; and a latching member mounted movably to the lever and extended through the arcuate slot, and a biasing means for urging the latching member into a selected one of the notches to releasably secure the lever and thereby selectively position the propeller in one of the retracted position and the at least one operating position.

18. The catamaran of claim 17 further including:

a pin integrally mounted to the drive shaft and a guide edge on the end of the sleeve confronting the propeller, the guide edge engaging the pin as the sleeve slides along the shaft toward the retracted position, further sliding of the sleeve beyond the engagement causing the pin to move angularly to rotate the drive shaft into a locked angular position.

19. The catamaran of claim 14 wherein:

the coupling means includes a gear train drivably associating a pedal and crank assembly with the propeller drive shaft, said drive gear comprising one of the gears in said gear train.

20. A manually propelled water craft, including:

a buoyant hull means including two spaced apart hull portions having respective bottom surface portions;

a rigid frame means connected to the buoyant hull means;

a manual drive means mounted for cyclical movement relative to the rigid frame means;

an elongate propeller drive shaft having a longitudinal axis and rotatable about the longitudinal axis, and a propeller mounted integrally to the propeller drive shaft;

a coupling means for operably coupling the propeller drive shaft and the manual drive means, to rotate the propeller responsive to the cyclical movement of the manual drive means;

a mounting means for mounting the propeller drive shaft for movement relative to the rigid frame means between a retracted position in which the propeller is above the bottom surface portions, and at least one operating position in which the propeller is underwater when the hull means is afloat;

a propeller position control means for releasably and adjustably securing the mounting means to selectively locate the propeller alternatively in one of the at least one operating position and the retracted position; and a means for locking the propeller drive shaft against rotation when the propeller drive shaft is in the retracted position.

21. The water craft of claim 20 wherein:

the mounting means includes a pivot arm having a first end pivotally secured to the rigid frame means, and a sleeve pivotally secured to a second end of the pivot arm and mounted for longitudinal sliding and for rotation relative to the propeller drive shaft; and wherein the means for locking the propeller drive shaft include a pin integrally mounted to the drive shaft and a guide edge of the sleeve, and guide edge engaging the pin as the sleeve slides along the drive shaft toward the retracted position.

* * * * *